US009039885B1

(12) United States Patent
Holland et al.

(10) Patent No.: US 9,039,885 B1
(45) Date of Patent: May 26, 2015

(54) ELECTROLYTIC SYSTEMS AND METHODS FOR MAKING METAL HALIDES AND REFINING METALS

(71) Applicant: Babcock & Wilcox Technical Services Y-12, LLC, Oak Ridge, TN (US)

(72) Inventors: Justin M. Holland, Clinton, TN (US); David M. Cecala, Knoxville, TN (US)

(73) Assignee: Consolidated Nuclear Security, LLC, Reston, VA (US)

( * ) Notice: Subject to any disclaimer, the term of this patent is extended or adjusted under 35 U.S.C. 154(b) by 318 days.

(21) Appl. No.: 13/626,222

(22) Filed: Sep. 25, 2012

(51) Int. Cl.
*C25C 3/00* (2006.01)
*C25B 1/24* (2006.01)

(52) U.S. Cl.
CPC .... *C25B 1/24* (2013.01); *C25C 3/00* (2013.01)

(58) Field of Classification Search
CPC ..... C25B 1/24
USPC ..... 205/359, 47, 49
See application file for complete search history.

(56) References Cited

U.S. PATENT DOCUMENTS 2,534,677 A 12/1950 Newton et al.
2,943,033 A * 6/1960 Blue et al. ..... 205/359
4,880,506 A 11/1989 Ackerman et al.
5,009,752 A * 4/1991 Tomczuk et al. ..... 205/44
6,689,260 B1 2/2004 Ahluwalia et al.
6,800,262 B1 10/2004 Miller et al.
7,267,754 B1 * 9/2007 Willit ..... 205/47
7,638,026 B1 * 12/2009 Willit et al. ..... 205/47

OTHER PUBLICATIONS

S. Yoshizawa, et al.; The Recovery of Chlorine From Hydrogen Chloride Part 1; New Method Using a Molten Salt as the Electrolyte; Journal of Applied Electrochemistry 1 (1971) pp. 245-251.

* cited by examiner

*Primary Examiner* — Bryan D. Ripa
(74) *Attorney, Agent, or Firm* — Michael J. Renner, Esq.; Luedeka Neely Group, P.C.

(57) ABSTRACT

Disclosed are electrochemical cells and methods for producing a halide of a non-alkali metal and for electrorefining the halide. The systems typically involve an electrochemical cell having a cathode structure configured for dissolving a hydrogen halide that forms the halide into a molten salt of the halogen and an alkali metal. Typically a direct current voltage is applied across the cathode and an anode that is fabricated with the non-alkali metal such that the halide of the non-alkali metal is formed adjacent the anode. Electrorefining cells and methods involve applying a direct current voltage across the anode where the halide of the non-alkali metal is formed and the cathode where the non-alkali metal is electro-deposited. In a representative embodiment the halogen is chlorine, the alkali metal is lithium and the non-alkali metal is uranium.

7 Claims, 2 Drawing Sheets

ELECTROLYTIC SYSTEMS AND METHODS FOR MAKING METAL HALIDES AND REFINING METALS

GOVERNMENT RIGHTS

The U.S. Government has rights to this invention pursuant to contract number DE-AC05-00OR22800 between the U.S. Department of Energy and Babcock & Wilcox Technical Services Y-12, LLC.

FIELD

This disclosure relates to the field of electrolytic chemistry. More particularly, this disclosure relates to the production of metal halides for electrorefining of metals.

BACKGROUND

Metal halides are useful for electrorefining metals. However, the production of many metal halides is difficult. In particular, current methods for the production of uranium trichloride ($UCl_3$) on a large scale require handling of highly pyrophoric uranium/uranium hydride fines or the use of toxic cadmium chloride as an oxidizer in a molten salt bath. It is desirable to eliminate the need for both of these reagents. Moreover, it is desirable in some circumstances to provide in-situ production of metal halides such as $UCl_3$. Consequently, improved systems and methods are needed for making metal halides, and in particular for making $UCl_3$ for electrorefining uranium.

SUMMARY

In some embodiments, the present disclosure provides an electrochemical cell for producing a metal halide. A typical electrochemical cell includes a container, a source of an acid of a halogen, and an electrolyte in the container. The composition of the electrolyte includes a molten salt of (a) the halogen and (b) an alkali metal. The electrochemical cell typically also includes an anode in the electrolyte where the anode includes a non-alkali metal. There is an anolyte portion of the electrolyte adjacent the anode. Generally there is a tube in the electrolyte, and the tube establishes a catholyte portion of the electrolyte and the tube has a permeable portion for ionic transportation. Typically a cathode is in the catholyte portion, and the cathode has a chemical feed passageway for flowing the hydrogen halide gas into the catholyte portion of the electrolyte. It is generally important that a portion of the hydrogen halide dissolves in the electrolyte that is in the catholyte portion of the electrolyte. The electrochemical cell typically includes a direct current power source that has an anode terminal that is in electrical connectivity with the anode and has a cathode terminal that is in electrical connectivity with the cathode. With this configuration, the hydrogen halide is electrolyzed adjacent the cathode to produce hydrogen and to produce anions of the halide that migrate to the anode and form the metal compound as a halide of the non-alkali metal adjacent the anode.

Another embodiment provides an electrochemical cell for producing an electrorefined non-alkali metal. This embodiment has a container and an electrolyte is in the container. The composition of the electrolyte includes a molten salt of (a) a halogen and (b) an alkali metal. In this embodiment there is an anode disposed in the electrolyte. An anolyte portion of electrolyte is adjacent the anode, and a halide consisting of (a) the halogen and (b) a non-alkali metal is disposed in the anolyte portion. There is a cathode disposed in the electrolyte. Further in this embodiment there is a direct current power source having an anode terminal that is in electrical connectivity with the anode and there is a cathode terminal that is in electrical connectivity with the cathode such that cations of the non-alkali metal migrate from the anolyte portion and are electro-deposited adjacent the cathode as the electrorefined non-alkali metal.

Method embodiments are provided for producing a non-alkali metal halide that includes a halogen and a non-alkali metal where the hydrogen halide has a solubility of at least 1 mmol/L in a molten salt of (a) the halogen and (b) an alkali metal. A typical method involves electrolytically dissociating at a cathode the hydrogen halide dissolved in the molten salt such that halogen anions and gaseous hydrogen are formed at the cathode. Such methods typically further involve electrolytically charging a metal at an anode in the molten salt such that cations of the non-alkali metal are formed at the anode. Such methods typically further involve combining the halogen anions and the cations of the non-alkali metal to form the metal compound adjacent the anode as a non-alkali metal halide.

Method embodiments are provided for producing an electrorefined non-alkali metal. Such methods generally involve disposing in a electrochemical cell having an anode and a cathode a mixture of (1) a halide consisting of a halogen and a non-alkali metal and (2) a molten salt of the halogen and an alkali metal. Then, typically, the methods involve applying a direct current potential across the anode and the cathode wherein cations of the non-alkali metal migrate from a region adjacent the anode and are electro-deposited adjacent the cathode as the electrorefined non-alkali metal.

In the various embodiments disclosed herein the halide is chlorine, the alkali metal is lithium and the non-alkali metal is uranium, such that $UCl_3$ is produced and/or electrorefined.

BRIEF DESCRIPTION OF THE DRAWINGS

Various advantages are apparent by reference to the detailed description in conjunction with the figures, wherein elements are not to scale so as to more clearly show the details, wherein like reference numbers indicate like elements throughout the several views, and wherein.

DETAILED DESCRIPTION

Figure 1:
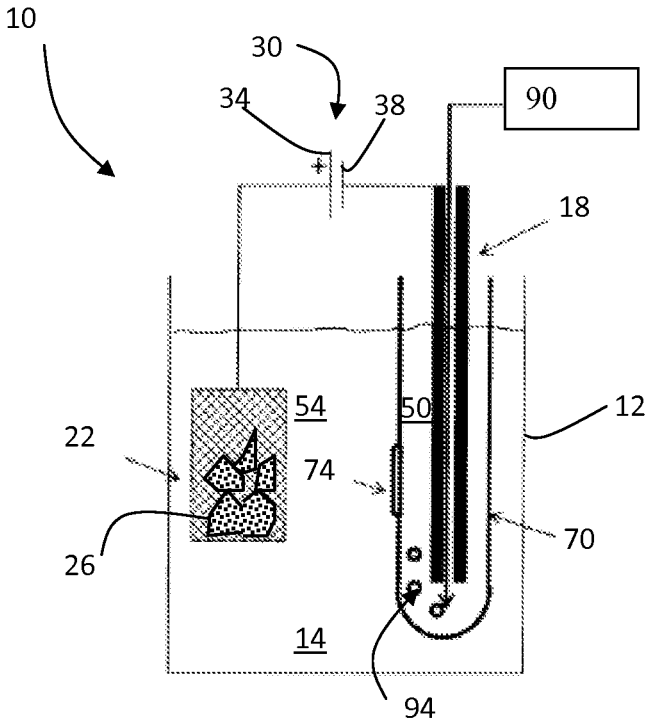
FIG. 1 is a somewhat schematic view of an electrochemical cell for production of a metal halide.

In the following detailed description of the preferred and other embodiments, reference is made to the accompanying drawings, which form a part hereof, and within which are shown by way of illustration the practice of specific embodiments of an electrochemical cell for making a metal halide and embodiments of methods for making metal halides. It is to be understood that other embodiments may be utilized, and that structural changes may be made and processes may vary in other embodiments.

Various embodiments disclosed herein provide systems and methods for the electrolysis of a hydrogen halide in a molten salt of (a) an alkali metal and (b) the halogen, to produce that halide of a non-alkali metal. For example, anhydrous hydrogen chloride may be electrolyzed in a molten lithium chloride salt in order to convert elemental uranium metal to uranium trichloride.

As used herein the term "halogen" refers to any of the elements of Table 1.

TABLE 1

| Atomic Number | Element |
|---|---|
| 9 | Fluorine |
| 17 | Chlorine |
| 35 | Bromine |
| 53 | Iodine |
| 85 | Astatine |

As used herein the term "alkali metal" refers to any of the elements in Table 2.

TABLE 2

| Atomic Number | Element |
|---|---|
| 3 | Lithium |
| 11 | Sodium |
| 19 | Potassium |
| 37 | Rubidium |
| 55 | Cesium |
| 87 | Francium |
| 4 | Beryllium |
| 12 | Magnesium |
| 20 | Calcium |
| 38 | Strontium |
| 56 | Barium |
| 88 | Radium |

Note that the "alkali metals" of Table 2 include elements that are sometimes elsewhere referred to as "alkaline earth metals."

As used herein the term "non-alkali metal" refers to any of the elements in Table 3.

TABLE 3

| Atomic No. | Name |
|---|---|
| 89 | Actinium |
| 90 | Thorium |
| 91 | Protactinium |
| 92 | Uranium |
| 93 | Neptunium |
| 94 | Plutonium |
| 95 | Americium |
| 96 | Curium |
| 97 | Berkelium |
| 98 | Californium |
| 99 | Einsteinium |
| 100 | Fermium |
| 101 | Mendelevium |
| 102 | Nobelium |
| 57 | Lanthanum |
| 58 | Cerium |
| 59 | Praseodymium |
| 60 | Neodymium |
| 61 | Promethium |
| 62 | Samarium |
| 63 | Europium |
| 64 | Gadolinium |
| 65 | Terbium |
| 66 | Dysprosium |
| 67 | Holmium |
| 68 | Erbium |
| 69 | Thulium |
| 70 | Ytterbium |
| 5 | Boron |
| 14 | Silicon |
| 51 | Antimony |

TABLE 3-continued

| Atomic No. | Name |
|---|---|
| 52 | Tellurium |
| 84 | Polonium |
| 32 | Germanium |
| 33 | Arsenic |
| 34 | Selenium |
| 13 | Aluminum |
| 31 | Gallium |
| 49 | Indium |
| 50 | Tin |
| 81 | Thallium |
| 82 | Lead |
| 83 | Bismuth |
| 41 | Niobium |
| 76 | Osmium |
| 21 | Scandium |
| 22 | Titanium |
| 23 | Vanadium |
| 24 | Chromium |
| 25 | Manganese |
| 26 | Iron |
| 27 | Cobalt |
| 28 | Nickel |
| 29 | Copper |
| 30 | Zinc |
| 39 | Yttrium |
| 40 | Zirconium |
| 42 | Molybdenum |
| 43 | Technetium |
| 44 | Ruthenium |
| 45 | Rhodium |
| 46 | Palladium |
| 47 | Silver |
| 48 | Cadmium |
| 71 | Lutetium |
| 72 | Hafnium |
| 73 | Tantalum |
| 74 | Tungsten |
| 75 | Rhenium |
| 77 | Iridium |
| 78 | Platinum |
| 79 | Gold |
| 80 | Mercury |

FIG. 1 illustrates one embodiment of an apparatus for electrolysis of a hydrogen halide in a molten salt of (a) an alkali metal and (b) a halogen, to produce that halide of a non-alkali metal. In FIG. 1, an electrochemical cell 10 includes a container 12 containing an electrolyte 14. The electrolyte includes the molten salt of (a) the alkali metal and (b) the halogen. For example, the alkali metal may be lithium and the halogen may be chlorine, and then the electrolyte 14 contains lithium chloride (LiCl). The electrochemical cell 10 has a cathode 18 and an anode 22. The cathode 18 is generally an inert material such as graphite that is shaped into a hollow tube. In the embodiment of FIG. 1, the cathode 18 has an open end, but, in other embodiments, the cathode may be a hollow tube with a closed end, provided that the tube has sufficient porosity to permit the flow of a gas through the walls of the tube. The anode 22 is a corrosion resistant mesh basket made from a material such as stainless steel or titanium. One or more bulk pieces or a powder of a non-alkali metal 26 is disposed in the mesh basket of the anode 22. For example, the non-alkali metal 26 may be uranium. In other embodiments, an anode for the electrochemical cell 10 may be fabricated integrally from a non-alkali metal. The advantage of using the mesh basket arrangement of FIG. 1 is that the non-alkali metal that is consumed during the operation of the electrochemical cell 10 may be easily replaced in the mesh basket, whereas an anode fabricated integrally from a non-alkali metal would have to be replaced in its entirety.

A direct current (DC) power supply 30 is provided. An anode terminal 34 of the DC power supply 30 is in electrical connectivity with the anode 22, and a cathode terminal 38 of the DC power supply 30 is in electrical connectivity with the cathode 18.

A catholyte portion 50 of the electrolyte 14 is proximate to the cathode 18, and an anolyte portion 54 of the electrolyte 14 is proximate to the anode 22. The anolyte portion 54 is not isolated from the bulk of the electrolyte 14 by any physical barrier, but the catholyte portion 50 and the cathode 18 are isolated from the anolyte portion 54 and the anode 22 and by a tube 70. Typically, the tube 70 is fabricated from quartz. The tube 70 has a permeable portion 74 for ionic transport, as subsequently described herein. Typically, the permeable portion 74 is formed with porous frits. A source 90 of a hydrogen halide is provided. For example, if the halogen is chlorine then the hydrogen halide may be anhydrous hydrogen chloride (HCl).

To operate the electrochemical cell 10, gas bubbles 94 of the hydrogen halide (e.g., bubbles of anhydrous HCl) are flowed into the catholyte portion 50 through the hollow tube 70 of the anode 18. Some of the hydrogen halide (from source 90) is dissolved into the electrolyte 14. In order for the process to operate, the solubility of the acid of the halogen into the molten salt (i.e., the molten salt of (a) the alkali metal and (b) the halogen) should be at least 1 mmol/L. Then, with the DC power supply 30 energized, the following reactions occur:

$$\text{Cathode: } 3HHn \rightarrow 3H^+ + 3Hn^- \quad \text{(Reaction 1a)}$$

$$3H^+ + 3e^- \rightarrow 3/2H_{2\,(g)} \quad \text{(Reaction 1b)}$$

$$\text{Anode: } M + 3Hn^- \rightarrow MHn_3 + 3e^- \quad \text{(Reaction 2)}$$

where the symbols "M"=the non-alkali metal and "Hn"=the halogen.

Thus, when the non-alkali metal is uranium and the halogen is chlorine, Reactions 1a, 1b and 2 are:

$$\text{Cathode: } 3HCl \rightarrow 3H^+ + 3Cl^- \quad \text{(Reaction 3a)}$$

$$3H^+ + 3e^- \rightarrow 3/2H_{2\,(g)} \quad \text{(Reaction 3b)}$$

$$\text{Anode: } U + 3Cl^- \rightarrow UCl_3 + 3e^- \quad \text{(Reaction 4)}$$

The net reaction is:

$$M + 3HHn \rightarrow MHn_3 + 3/2H_{2\,(g)} \quad \text{(Reaction 5)}$$

such that when the non-alkali metal is uranium and the halogen is chlorine, Reaction 5 is:

$$U + 3HCl \rightarrow UCl_3 + 3/2H_{2\,(g)} \quad \text{(Reaction 6)}$$

A halide of a non-alkali metal (e.g., $UCl_3$) is formed at the anode and hydrogen gas is formed at the cathode. The halide of the non-alkali metal (e.g., $UCl_3$) is produced as a mixture with molten salt of (a) the alkali metal and (b) the halogen (e.g., LiCl).

It is important to note that the same halogen is used in the hydrogen halide (from source 90) and in the molten salt of the alkali metal that is the electrolyte 14. Thus, if the non-alkali metal is uranium and the molten salt of the alkali metal is LiCl, then the hydrogen halide that is used is HCl such that $UCl_3$ is produced as the halide of the non-alkali metal.

Figure 2:
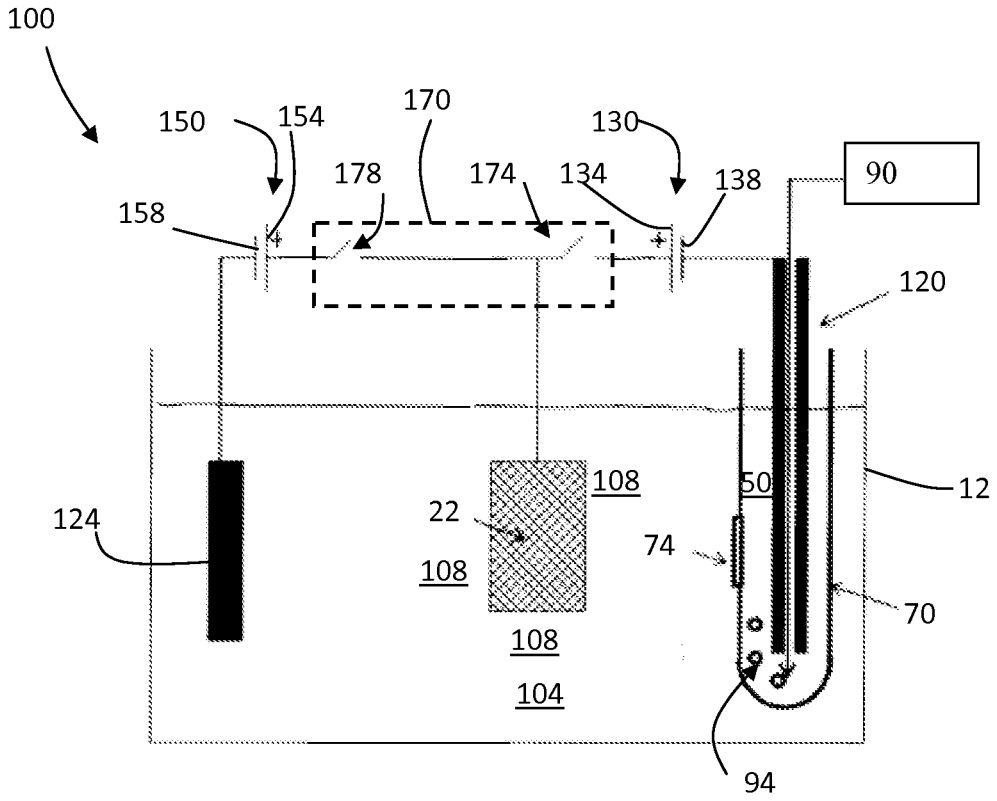
FIG. 2 is a somewhat schematic view of a cell for production of a metal halide and electrorefining of the metal halide.

FIG. 2 illustrates an embodiment of an electrochemical cell 100 where the halide of the non-alkali metal (e.g., $UCl_3$) may be electrorefined in-situ. The electrochemical cell 100 of FIG. 2 includes many of the same components of the electrochemical cell of FIG. 1. One exception is that the non-alkali metal 26 that was disposed in the mesh basket of the anode 22 in FIG. 1 has been electrochemically converted to a halide of the non-alkali metal (such as by operation of the electrochemical cell 10). Consequently, in the embodiment of FIG. 2 the halide of the non-alkali metal (e.g., $UCl_3$) and a molten salt of (a) an alkali metal and (b) the halogen (e.g., LiCl) form a mixture 104. Typically, the halide of the non-alkali metal is at an overall concentration of about 5-10 wt % of the mixture 104. There is natural convection in the molten salt that mixes the molten salt fairly well, albeit more slowly than mechanical stirring.

The electrochemical cell 100 of FIG. 2 has two cathodes. The cathode 18 of electrochemical cell 10 in FIG. 1 is designated as a first cathode 120 in FIG. 2, and the other cathode in FIG. 2 is designated as a second cathode 124. The second cathode 124 is typically formed from a material such as graphite, stainless steel or titanium.

The electrochemical cell 100 has two DC power sources. The DC power source 30 in FIG. 1 is designated as a first DC power source 130 in FIG. 2, with the first DC power source 130 having a first anode terminal 134 and a first cathode terminal 138. The other DC power source for electrochemical cell 100 is designated as a second DC power source 150. The second DC power source 150 has a second anode terminal 154 and a second cathode terminal 158.

The electrochemical cell 100 has an electrical switching system 170 that includes a first electrical switch 174 and a second electrical switch 178. These switches permit the electrochemical cell 100 to be operated in either production mode (for producing a halide of the alkali metal) or a refining mode (for electrorefining the halide of the alkali metal).

When the electrochemical cell 100 is in the electrorefining mode, the first electrical switch 174 is open and the second electrical switch 178 is closed. In this configuration the second anode terminal 154 is in electrical connectivity with the anode 22 and the second cathode terminal 158 is in electrical connectivity with the second cathode 124, and the following reactions occur:

$$\text{Anode: } M + 3Hn^- \rightarrow MHn_3 + 3e^- \quad \text{(Reaction 7)}$$

$$\text{Cathode: } MHn_3 + 3e^- \rightarrow M + 3Hn^- \quad \text{(Reaction 8)}$$

where the symbol "M"=the non-alkali metal and "Hn"=the halogen.

Thus, when the non-alkali metal is uranium and the halogen is chlorine, reactions 7 and 8 are:

$$\text{Anode: } U + 3Cl^- \rightarrow UCl_3 + 3e^- \quad \text{(Reaction 9)}$$

$$\text{Cathode: } UCl_3 + 3e^- \rightarrow U + 3Cl^- \quad \text{(Reaction 10)}$$

The net reaction is:

$$M + MHn_3 \rightarrow MHn_3 + M \quad \text{(Reaction 11)}$$

such that when the non-alkali metal is uranium and the halogen is chlorine, Reaction 11 is:

$$2U + UCl_3 \rightarrow 3U + 3Cl^- \quad \text{(Reaction 12)}$$

In other words, cations of the non-alkali metal in the anolyte portion 108 of the mixture 104 migrate from the anolyte portion 108 and are electro-deposited adjacent the second cathode 124. The halogen ions act as a mechanism for transporting ions of the non-alkali from the anode to the cathode. When the non-alkali metal is deposited on the cathode, the halogen ions are released back into the salt so that they are free to grab another non-alkali metal ion from the anode. In the case where the halogen is chlorine and the non-alkali metal is uranium, $U^{3+}$ ions migrate from the anolyte portion 108 and are electro-deposited adjacent the second cathode 124 as uranium metal while the chlorine items shuttle back and forth between the anode and the cathode.

When the electrochemical cell 100 is in the non-alkali metal halide production mode, a non-alkali metal (such as the non-alkali metal 26 of FIG. 1) is disposed in the wire mesh anode 22 and the first electrical switch 174 is in the closed position and the second electrical switch 178 is in the open position. In this configuration the electrochemical cell 100 operates in the same fashion as described hereinbefore with regard to the electrochemical cell 10 of FIG. 1.

It is important to note that the net reaction in Reaction 6 (shown above) is spontaneous at elevated temperatures. However, that reaction is kinetically slow due to the formation of $UCl_3$ that presents a barrier to the HCl reactant. In a molten salt bath the $UCl_3$ is dissolved, so uranium may be converted to $UCl_3$ in a molten salt bath by simply bubbling HCl over the uranium metal. A key advantage of making the $UCl_3$ using methods described herein is the ability to keep the HCl contained in the catholyte compartment. By equipping the catholyte compartment with a low porosity membrane that allows primarily ionic conduction, the HCl will remain confined. This also mitigates potential corrosion of the electrorefiner structural materials without a need to remove dissolved HCl from the molten salt prior to electrorefining.

While the electrochemical cell 100 is depicted with two DC power supplies 130 and 150, in some embodiments a single power supply may be used with an electrical switching system that switches its anode terminal and cathode terminal to the configurations described for the production mode and the electrorefining mode.

In summary, embodiments disclosed herein provide systems and methods for producing a halide of a non-alkali metal and for electrorefining the halide of the non-alkali metal. The foregoing descriptions of embodiments have been presented for purposes of illustration and exposition. They are not intended to be exhaustive or to limit the embodiments to the precise forms disclosed. Obvious modifications or variations are possible in light of the above teachings. The embodiments are chosen and described in an effort to provide the best illustrations of principles and practical applications, and to thereby enable one of ordinary skill in the art to utilize the various embodiments as described and with various modifications as are suited to the particular use contemplated. All such modifications and variations are within the scope of the appended claims when interpreted in accordance with the breadth to which they are fairly, legally, and equitably entitled.

What is claimed is:

1. An electrochemical cell for producing a non-alkali metal halide comprising:

a container;

a source of a hydrogen halide, the halogen selected from the group consisting of fluorine, chlorine, bromine, iodine, and astatine;

an electrolyte disposed in the container, the electrolyte comprising a molten salt comprising (a) the halogen and (b) an alkali metal selected from the group consisting of lithium, sodium, potassium, rubidium, cesium, francium, beryllium, magnesium, calcium, strontium, barium, and radium;

an anode disposed in the electrolyte, the anode comprising a non-alkali metal selected from the group consisting of actinium, thorium, protactinium, uranium, neptunium, plutonium, americium, curium, berkelium, californium, einsteinium, fermium, mendelevium, nobelium, lanthanum, cerium, praseodymium, neodymium, promethium, samarium, europium, gadolinium, terbium, dysprosium, holmium, erbium, thulium, ytterbium, boron, silicon, antimony, tellurium, polonium, germanium, arsenic, selenium, aluminum, gallium, indium, tin, thallium, lead, bismuth, niobium, osmium, scandium, titanium, vanadium, chromium, manganese, iron, cobalt, nickel, copper, zinc, yttrium, zirconium, molybdenum, technetium, ruthenium, rhodium, palladium, silver, cadmium, lutetium, hafnium, tantalum, tungsten, rhenium, iridium, platinum, and gold;

an anolyte portion of the electrolyte adjacent the anode;

a tube disposed in the electrolyte, the tube establishing a catholyte portion of the electrolyte;

a first cathode disposed in the catholyte portion, the first cathode having a chemical feed passageway connected to the source of the hydrogen halide for flowing the hydrogen halide into the catholyte portion such that a portion of the hydrogen halide dissolves in the electrolyte in the catholyte portion; and a direct current power source having an anode terminal in electrical connectivity with the anode and a cathode terminal in electrical connectivity with the first cathode wherein the hydrogen halide is electrolyzed adjacent the first cathode to produce hydrogen and to produce anions of the halogen that migrate from the catholyte portion to the anode and form the non-alkali metal halide adjacent the anode.

2. The electrochemical cell of claim 1 wherein the halogen is chlorine, the alkali metal is lithium and the non-alkali metal is uranium.

3. The electrochemical cell of claim 1 wherein the tube includes a permeable portion so that the hydrogen and anions of the halogen produced by electrolyzing the hydrogen halide migrate from the catholyte portion through the permeable portion to the anode.

4. A method of producing a non-alkali metal halide using the electrochemical cell of claim 1 comprising (a) a halogen selected from the group consisting of fluorine, chlorine, bromine, iodine, and astatine and (b) a non-alkali metal selected from the group consisting of actinium, thorium, protactinium, uranium, neptunium, plutonium, americium, curium, berkelium, californium, einsteinium, fermium, mendelevium, nobelium, lanthanum, cerium, praseodymium, neodymium, promethium, samarium, europium, gadolinium, terbium, dysprosium, holmium, erbium, thulium, ytterbium, boron, silicon, antimony, tellurium, polonium, germanium, arsenic, selenium, aluminum, gallium, indium, tin, thallium, lead, bismuth, niobium, osmium, scandium, titanium, vanadium, chromium, manganese, iron, cobalt, nickel, copper, zinc, yttrium, zirconium, molybdenum, technetium, ruthenium, rhodium, palladium, silver, cadmium, lutetium, hafnium, tantalum, tungsten, rhenium, iridium, platinum, and gold where an acid of the halogen has a solubility of at least 1 mmol/L in a molten salt comprising (a) the halogen and (b) an alkali metal selected from the group consisting of lithium, sodium, potassium, rubidium, cesium, francium, beryllium, magnesium, calcium, strontium, barium, and radium, the method comprising:

electrolytically dissociating at a cathode the hydrogen halide dissolved in the molten salt, wherein halogen anions and gaseous hydrogen are formed at the cathode; and electrolytically charging a metal at an anode in the molten salt wherein cations of the non-alkali metal are formed at the anode; and combining the halogen anions and the cations of the non-alkali metal to form the non-alkali metal halide adjacent the anode.

5. The method of claim 4 wherein the halogen is chlorine, the alkali metal is lithium and the non-alkali metal is uranium.

6. An electrochemical cell for producing a non-alkali metal halide and electrorefining the non-alkali metal comprising:

a container;

a source of a hydrogen halide, the halogen selected from the group consisting of fluorine, chlorine, bromine, iodine, and astatine;

an electrolyte disposed in the container, the electrolyte comprising a molten salt comprising (a) the halogen and (b) an alkali metal selected from the group consisting of lithium, sodium, potassium, rubidium, cesium, francium, beryllium, magnesium, calcium, strontium, barium, and radium;

an anode disposed in the electrolyte, the anode comprising a non-alkali metal selected from the group consisting of actinium, thorium, protactinium, uranium, neptunium, plutonium, americium, curium, berkelium, californium, einsteinium, fermium, mendelevium, nobelium, lanthanum, cerium, praseodymium, neodymium, promethium, samarium, europium, gadolinium, terbium, dysprosium, holmium, erbium, thulium, ytterbium, boron, silicon, antimony, tellurium, polonium, germanium, arsenic, selenium, aluminum, gallium, indium, tin, thallium, lead, bismuth, niobium, osmium, scandium, titanium, vanadium, chromium, manganese, iron, cobalt, nickel, copper, zinc, yttrium, zirconium, molybdenum, technetium, ruthenium, rhodium, palladium, silver, cadmium, lutetium, hafnium, tantalum, tungsten, rhenium, iridium, platinum, and gold;

an anolyte portion of the electrolyte adjacent the anode;

a tube disposed in the electrolyte, the tube establishing a catholyte portion of the electrolyte and having a permeable portion;

a first cathode disposed in the catholyte portion, the first cathode having a chemical feed passageway connected to the source of the hydrogen halide for flowing the hydrogen halide into the catholyte portion such that a portion of the hydrogen halide dissolves in the electrolyte in the catholyte portion;

a second cathode disposed in the electrolyte;

a direct current power source having an anode terminal and a cathode terminal; and an electrical switching system having a first configuration where the anode terminal is in electrical connectivity with the anode and the cathode terminal is in electrical connectivity with the first cathode wherein the hydrogen halide is electrolyzed adjacent the first cathode to form hydrogen and anions of the halogen that migrate from the catholyte portion to the anode and form the non-alkali metal halide adjacent the anode, and the electrical switching system having a second configuration where the anode terminal is in electrical connectivity with the anode and the cathode terminal is in electrical connectivity with the second cathode wherein cations of the non-alkali metal in the anolyte portion migrate from the anolyte portion and are electro-deposited adjacent the second cathode.

7. The electrochemical cell of claim 6 wherein the halogen is chlorine, the alkali metal is lithium and the non-alkali metal is uranium.

* * * * *